US006067095A

United States Patent [19]

Danieli

[11] Patent Number: 6,067,095

[45] Date of Patent: May 23, 2000

[54] METHOD FOR GENERATING MOUTH FEATURES OF AN ANIMATED OR PHYSICAL CHARACTER

[75] Inventor: Damon Vincent Danieli, Bellevue, Wash.

[73] Assignee: Microsoft Corporation, Redmond, Wash.

[21] Appl. No.: 08/795,711

[22] Filed: Feb. 4, 1997

[51] Int. Cl.[7] ..... G00T 15/70; G09G 5/00

[52] U.S. Cl. ..... 345/473; 345/474; 345/121; 704/262

[58] Field of Search ..... 345/472, 473, 345/469, 468, 474, 121, 131, 136, 501; 704/200, 262, 235, 260, 275, 219, 203

[56] References Cited

U.S. PATENT DOCUMENTS

| | | | |
|---|---|---|---|
| 3,493,674 | 2/1970 | Houghton . | |
| 3,743,767 | 7/1973 | Bitzer et al. . | |
| 3,891,792 | 6/1975 | Kimura . | |
| 3,900,887 | 8/1975 | Soga et al. . | |
| 3,993,861 | 11/1976 | Baer . | |
| 4,186,413 | 1/1980 | Mortimer . | |
| 4,207,704 | 6/1980 | Akiyama . | |
| 4,540,176 | 9/1985 | Baer . | |
| 4,599,644 | 7/1986 | Fischer . | |
| 4,660,033 | 4/1987 | Brandt . | |
| 4,665,431 | 5/1987 | Cooper . | |
| 4,840,602 | 6/1989 | Rose . | |
| 4,846,693 | 7/1989 | Baer . | |
| 4,847,699 | 7/1989 | Freeman . | |
| 4,847,700 | 7/1989 | Freeman . | |
| 4,864,607 | 9/1989 | Mitamura et al. . | |
| 4,930,019 | 5/1990 | Chu . | |
| 4,941,178 | 7/1990 | Chuang | 381/41 |
| 4,949,327 | 8/1990 | Forsse et al. . | |
| 5,021,878 | 6/1991 | Lang . | |
| 5,108,341 | 4/1992 | DeSmet . | |
| 5,198,893 | 3/1993 | Lang . | |
| 5,270,480 | 12/1993 | Hikawa . | |
| 5,630,017 | 5/1997 | Gasper et al. | 395/2.85 |
| 5,655,945 | 8/1997 | Jani . | |
| 5,689,618 | 11/1997 | Gasper et al. | 395/2.85 |

FOREIGN PATENT DOCUMENTS

WO/91/10490 7/1991 WIPO .

OTHER PUBLICATIONS

Rabiner et al., "Linear Predictive Coding of Speech," Chap. 8, *Digital Processing Of Speech Signals*, pp. 396–461, Prentice–Hall, Inc., Englewood Cliffs, N.J., 1978.

*Primary Examiner*—Joseph H. Feild
*Assistant Examiner*—Alford W. Kindred
*Attorney, Agent, or Firm*—Jones & Askew, LLP

[57] ABSTRACT

A method and system for determining the mouth features, i.e., the lip position and mouth opening, of an animated character. Lip position is the shape and position of the lips of the animated character. Mouth opening is the amount of opening between the lips of the animated character. A time-domain signal corresponding to the speech of the animated character may be digitally sampled. The sampled voice signal is separated into a number of frames of a specific time length. A Hamming window is applied to each frame to de-emphasize the boundary conditions of each frame. A linear predictive coding (LPC) technique is applied to each of the frames, resulting in a gain for each of the frames and a number of k coefficients, or reflection coefficients, including a voiced/nonvoiced coefficient and a pitch coefficient. The reflection coefficients for each frame are mapped to the Cepstral domain resulting in a number of Cepstral coefficients for each frame. The Cepstral coefficients are vector quantized to achieve a vector quantization result representing the character's lip position. For a predetermined number of frames, a local maximum and a local minimum of gain are found. The gain for each of the frames containing a local minimum is set to a fully closed mouth opening and the gain for each of the frames containing a local maximum is set to a fully open mouth opening. The vector quantization result and gain are applied to an empirically derived mapping function to determine the mouth features of the character.

20 Claims, 12 Drawing Sheets

METHOD FOR GENERATING MOUTH FEATURES OF AN ANIMATED OR PHYSICAL CHARACTER

REFERENCE TO RELATED APPLICATIONS

This application is related to the subject matter disclosed in U.S. application Ser. Nos. 08/794,921 entitled "A SYSTEM AND METHOD FOR CONTROLLING A REMOTE DEVICE" filed Feb. 4, 1997, 08/795,698 entitled "SYSTEM AND METHOD FOR SUBSTITUTING AN ANIMATED CHARACTER WHEN A REMOTE CONTROL PHYSICAL CHARACTER IS UNAVAILABLE" filed Feb. 4, 1997, and 08/795,710 entitled "PROTOCOL FOR A WIRELESS CONTROL SYSTEM" filed Feb. 4, 1997 which are assigned to a common assignee and which are incorporated herein by reference.

TECHNICAL FIELD

This invention relates to a system and method for determining the lip position and mouth opening of a talking animated character. More particularly, this invention relates to a method and system for synchronizing the position of the mouth and lips of a talking animated character with the words that the character is speaking.

BACKGROUND OF THE INVENTION

Animated and computer-generated cartoons have become quite sophisticated. Some full-length animated motion pictures starring animated characters have generated millions of dollars in revenue from ticket sales and sales of licensed merchandise. The characters in these cartoons and movies usually move and talk realistically. At least part of the success of these movies can be attributed to this life-like motion of the characters.

Synchronizing the mouth features of a speaking animated character to the speech of the character is particularly difficult. Poor synchronization can result in characters appearing as though they were in a poorly dubbed foreign film. Proper synchronization of the mouth features of a character to the speech of the character can be difficult and expensive to achieve.

The mouth features of an animated character can be described by two attributes: the position of the lips, i.e., lip position, and the amount of opening between the lips, i.e., mouth opening. Sometimes, an animator draws the mouth features of an animated character by examining his face in a mirror to determine his lip position and the mouth opening as he speaks the words that the character is to speak. This process of drawing the lip position and mouth opening of an animated character can be time-consuming. In addition, this process can result in an inaccurate representation of speech.

For instance, if the animated sequence contains 10 frames or cells per second, then the animator must estimate the character's lip position and mouth opening at one-tenth of a second intervals to achieve synchronization. This estimation requires a great deal of experience to perfect and, even with experience, this process can result in poor synchronization. In addition, this process can be time-consuming and expensive if the animator must redraw the mouth features to synchronize them with the character's speech. Thus, there is the need in the art for a method for determining the lip position and the opening between the lips of a speaking animated character that is quick, efficient and accurate.

Speaking characters are not only seen in cartoons and motion pictures. For example, talking mechanical, or stuffed, characters are popular, especially with children. The problems of synchronizing the lip position and mouth opening of a talking mechanical character are in many ways similar to the problems of synchronizing the lip position and mouth opening of a cartoon character. For instance, poor synchronization may result in the mechanical character's mouth appearing to open and close like a mousetrap rather than like a mouth of a human being. Thus, there is the need in the art for a quick, efficient and effective method for determining the lip position and the opening between the lips of a speaking mechanical character.

One method that has been used to determine the mouth opening of a speaking mechanical character is integrating over time the time-domain voice signal that the mechanical character is to speak. The result of this integration is stored in a capacitor and used as a rough approximation of the amount of opening between the lips of the mechanical character. One disadvantage of this method is that it only gives a rough approximation of how wide the mouth of the character should be opened, resulting in a coarse granularity that may appear as a simple opening and closing of the mouth of the mechanical character. Another disadvantage of this method is that this method does not provide any information about the position of the lips of the mechanical character. For example, the lips determine whether someone is pronouncing an "a" or a "t" sound. Without defining lip position, the synchronization of the mouth features to the speech of the mechanical character is not fully realized. Still another disadvantage is that this method requires discrete analog components, such as capacitors, that are not easily compatible with a digital environment.

Therefore, there is a need in the art for a quick, efficient and accurate method for determining lip position and mouth opening for both mechanical and animated characters. There is a further need for a method for determining lip position and mouth opening that has a fine granularity, i.e., provides an accurate representation of lip position and mouth opening. There is a further need for a method for determining lip position and mouth opening that is compatible with a digital environment. There is still a further need for a method for synchronizing the mouth features of an animated or mechanical character to the speech of the character that takes into account not only the amount of opening between the lips of the character, but also the position of the lips.

SUMMARY OF THE INVENTION

The present invention satisfies the above described needs by providing a system for synchronizing the mouth features, i.e., lip position and mouth opening, of a speaking animated or mechanical character to the words that are spoken by the character.

In one aspect, the present invention determines the mouth opening of a character by sampling a time-domain voice signal corresponding to the speech of the mechanical or animated character. The sampled voice signal is then separated into frames. A windowing technique is applied to each of the frames to de-emphasize the boundary conditions of the samples. A linear predictive coding (LPC) technique is applied to each of the frames resulting in LPC coefficients and a gain for each of the frames. The LPC coefficients and the gain can then be used to provide a good approximation of the mouth opening of the character.

In another aspect, the present invention not only determines mouth opening, but also lip position. The LPC coefficients for each frame are mapped to the Cepstral domain to obtain a plurality of Cepstral coefficients for each frame. The Cepstral coefficients are vector quantized to obtain a vector quantization result corresponding to the lip position of the mechanical character. The vector quantization result and the gain for each frame are applied to a mapping function to obtain the mouth features of the character corresponding to each frame of the time-domain voice signal. The mapping function can be implemented by a lookup table or another data table.

Before applying the vector quantization result and the gain for each frame to the mapping function, a local maximum for gain and a local minimum for gain can be determined within a predetermined number of frames. The gain for the frame with the local minimum can be adjusted to be equal to a minimum gain level and the gain for the frame with the local maximum can be adjusted to be equal to a maximum gain level. Because the gain corresponds to the mouth opening of the character, adjusting the gain to be at the maximum gain and minimum gain within a predetermined number of frames causes the character to fully open and fully close his mouth within the predetermined number of frames. This opening and closing allows the character's speech to appear smooth and life-like.

In yet another aspect, the present invention is a method for determining mouth features, such as mouth opening and lip position, of a talking character. A time-domain voice signal corresponding to the speech of the character is sampled and separated into a plurality of frames. A windowing technique, such as a Hamming window, is applied to each of the frames. A LPC technique can then be applied to each of the frames to generate a number of LPC coefficients and a gain for each of the frames. The linear predictive coding coefficients can be mapped to the Cepstral domain to obtain a number of Cepstral coefficients for each of frames. The Cepstral coefficients for each frame can then be vector quantized to obtain a lip position of the character for each frame. A local maximum of the gain and a local minimum of the gain may be calculated within a predetermined number of frames. The gain for each of the frames containing a local minimum can be adjusted to equal a minimum gain and the gain for each of the frames containing a local maximum can be adjusted to equal a maximum gain. The lip position and the gain for each frame can then be applied to an empirically derived mapping function to obtain the mouth features of the character for each frame.

These and other features, advantages, and aspects of the present invention may be more clearly understood and appreciated from a review of the following detailed description of the disclosed embodiments and by reference to the appended drawings and claims.

DETAILED DESCRIPTION

Figure 1:
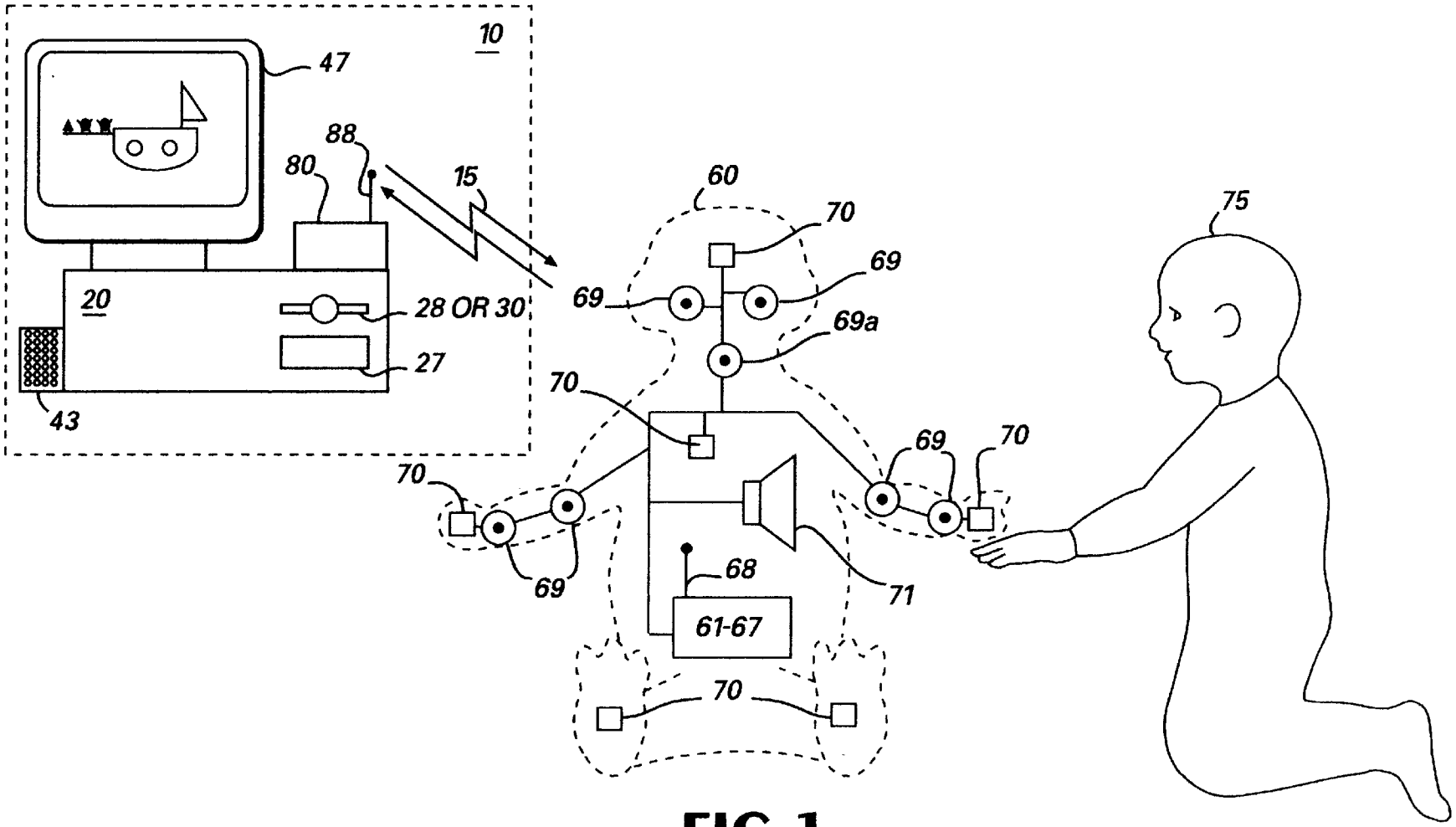
FIG. 1 is an illustration of an exemplary environment for a duplex embodiment of the present invention.

The present invention is directed toward a system for determining the lip position and mouth opening of a talking animated character. More particularly, this invention relates to a method and system for synchronizing the lip position and opening between the lips of an animated or mechanical character with the words that the character is speaking. In one embodiment, the invention is incorporated into a Realmation system marketed by Microsoft Corporation of Redmond, Wash.

Referring now to the drawings, in which like numerals represent like elements throughout the several figures, aspects of the present invention and the exemplary operating environment will be described.

Exemplary Operating Environment

Aspects of the present invention are described within the context of a system that includes a master device, which communicates with and controls one or more slave devices through a radio frequency (RF) communication channel. More specifically, aspects of the present invention are particularly applicable within a "realmation" system. "Realmation," derived from combining the words "realistic" and "animation," is descriptive of a technology developed by Microsoft Corporation of Redmond Wash. An example of a realmation system includes a master device, such as a computer system with a display, which communicates with and controls one or more slave devices, such as mechanical characters. The master device provides scenes of an animated audio/video presentation on the display while simultaneously transmitting control information and speech data to one or more mechanical characters. The mechanical characters, in response to receiving the control information and speech data, move and talk in context with the animated audio/video presentation.

The engineers of Microsoft Corporation have developed a realmation product including two main components: a Realmation Control System acting as the master device, and one or more Realmation Performers acting as slave devices. The Realmation Performers may include a variety of devices that are useful for industrial, educational, research, entertainment or other similar purposes. Each realmation Performer includes an RF transceiver system for receiving, demodulating, and decoding signals originating from the Realmation Control System. The signals originating from the Realmation Control System contain control information and speech data. The RF transceiver within each Realmation Performer may also encode, modulate and transmit signals to the Realmation Control System. These transmitted signals carry status information concerning the Realmation Performer to the Realmation Control System.

The Realmation Control System governs the operation of one or more Realmation Performers while displaying an animated audio/video presentation. The Realmation Control System includes a realmation data source, a Realmation Link Master, and a display system. The realmation data source may be an active device, such as computer system, that controls the Realmation Link Master and provides for the input of realmation data. Alternatively, the realmation data source may be a passive device, such as a computer, VCR or TV tuner, that feeds realmation data to the Realmation Link Master. Another alternative includes combining the realmation data source with the Realmation Link Master to form a "smart" Realmation Link Master. Regardless of the configuration, the realmation data source provides for the input of realmation data, and the Realmation Link Master transmits the realmation data to one or more Realmation Performers.

The main function of the Realmation Link Master is to receive realmation data from the realmation data source, encode the realmation data, and transmit the encoded realmation data to one or more Realmation Performers. In addition, the Realmation Link Master may receive response signals from the Realmation Performers and decode the response signals to recover realmation data.

Two exemplary embodiments of a realmation product include a simplex embodiment and a duplex embodiment. Exemplary embodiments of the Realmation Control System, the Realmation Link Master and the Realmation Performers will be generally described in the context of programs running on microprocessor-based systems. Those skilled in the art will recognize that implementations of the present invention may include various types of programs, use various programming languages, and operate with various types of computing equipment. Additionally, although the descriptions of exemplary embodiments portray the Realmation Control System as controlling a Realmation Performer over an RF communication channel, those skilled in the art will appreciate that substitutions to the RF communication channel can include other communication mediums such as fiber optic links, copper wires, infrared signals, etc.

Generally, a program, as defined herein, includes routines, sub-routines, program modules, components, data structures, etc., that perform particular tasks or implement particular abstract data types. Moreover, those skilled in the art will appreciate that aspects of the present invention are applicable to other computer system configurations. These other computer system configurations include, but are not limited to, hand-held devices, multiprocessor systems, microprocessor-based or programmable consumer electronics, minicomputers, mainframe computers, and the like. Aspects of the present invention are also applicable within the context of a distributed computing environment that includes tasks being performed by remote processing devices that are linked through a communications network. In a distributed computing environment, program modules may be located in both local and remote memory storage devices.

In both the simplex and duplex embodiments, the Realmation Performers are low-cost, animated, mechanical characters intended to provide an interactive learning and entertainment environment for children. At minimum, each Realmation Performer includes a receiver system, a speech synthesizer, a speaker, a processing unit, and one or more servo motors. In response to the receiver system receiving realmation data, the processing unit decodes, interprets, and responds in a manner dictated by the contents of the realmation data. The response of the processing unit may include actuating one or more servo motors and/or providing input to the speech synthesizer.

In the duplex embodiment, each Realmation Performer further includes one or more sensor devices and a transmitter system. The sensor devices may detect actions such as a child squeezing the hand, covering the eyes, or changing the position of the Realmation Performer. By monitoring output signals from the sensors, the processing unit may collect status information. Upon receiving a request from the Realmation Control System or by making an autonomous decision, the processing unit can transmit the sensor status information to the Realmation Control System. In response to receiving the sensor status information, the Realmation Control System may alter the animated audio/video presentation in a manner commensurate with the information. For example, in response to the action of a child covering the eyes of the Realmation Performer, the animated audio/video presentation may switch to a game of peek-a-boo.

Thus, in the duplex embodiment, the Realmation Control System engages in bidirectional communication with one or more Realmation Performers. Although the description of this exemplary embodiment of the Realmation Control System portrays a program running on a personal computer and cooperating with another program running on a microprocessor-based communication device, those skilled in the art will recognize that other implementations, such as a single program running on a stand-alone platform, or a distributed computing device equipped with radio communication equipment, may also suffice.

In the simplex embodiment, the Realmation Control System engages in uni-directional communication with one or more Realmation Performers. Although the description of the simplex embodiment of the Realmation Control System portrays a video cassette recorder (VCR) or a cable TV box interfacing with a program running on a microprocessor-based communication device, those skilled in the art will recognize that other implementations, such as direct broadcasting signals, laser disc players, video tape players, computing devices accessing CD-ROM's, etc., may also suffice. Additionally, this embodiment may include integrating a VCR or similar device with a microprocessor-based communication device for operating in a stand-alone configuration.

The communication between the master and slave devices will be described in the context of RF signal transmissions formed in accordance with amplitude modulation ("AM") techniques. The RF signals are used to transfer symbolic representations of digital information from one device to another. The RF signals are generated by modulating the amplitude of a carrier signal in a predetermined manner based on the value of a symbolic representation of the digital data. It should be understood that a variety of communication technologies may be utilized for transmitting the information between these devices and that describing the use of AM techniques should not restrict the principles of any aspect of the present invention.

Referring now to the drawings, in which like numerals represent like elements throughout the several figures, aspects of the present invention and exemplary operating environments will be described. FIGS. 1–7, in conjunction with the following discussion, are intended to provide a brief, general description of suitable environments in which the present invention may be implemented.

Duplex Embodiment: Personal Computer-Based System

FIG. 1 illustrates an exemplary environment for a duplex embodiment of the present invention. This environment presents a child with an interactive learning setting that includes a Realmation Control System 10 which controls and interacts with a Realmation Performer 60. The Realmation Control System 10 includes a conventional personal computer 20; a Realmation Link Master 80; an antenna 88; a speaker 43; and a display device 47. The personal computer 20 may include a hard disk drive 27, a magnetic disk drive 28, and/or an optical disk drive 30.

During operation, the Realmation Control System 10 controls an audio/video presentation on display device 47 and speaker 43. In addition, the Realmation Control System 10 transmits realmation data to the Realmation Performer 60. The realmation data contains control data and speech data for controlling the operation of the Realmation Performer 60. The process of transmitting the realmation data includes encoding the realmation data, modulating a carrier with the encoded realmation data, and emitting the modulated carrier as an RF signal from antenna 88 over RF communication channel 15.

The Realmation Performer 60 receives the RF signals from the Realmation Control System at antenna 68. The receiver system 61–67 processes the received RF signals to recover the realmation data. The Realmation Performer 60 interprets the received realmation data and responds to the realmation data by controlling the operation of one or more servo motors 69, including at least one mouth servo motor 69*a,* embodied within the Realmation Performer 60 and/or by providing speech data to be audibly presented on speaker 71. Thus, transmitting the appropriate realmation data to the Realmation Performer 60 causes the Realmation Performer 60 to move and talk as though it is an extension of the audio/video presentation.

The Realmation Performer 60 also includes light sensors and touch sensors 70. In response to a child touching, squeezing or moving the Realmation Performer 60 in an appropriate manner, the light sensors and/or touch sensors 70 within the Realmation Performer 60 may generate status information. In response to a command from the Realmation Control System 10, the Realmation Performer 60 may transmit the status information over the RF communication channel 15 to the Realmation Link Master 80 for processing by the Realmation Control System 10. By receiving and interpreting the status information, the Realmation Control System 10 can alter the progression of the audio/video presentation in a manner commensurate with the status information.

Figure 2:
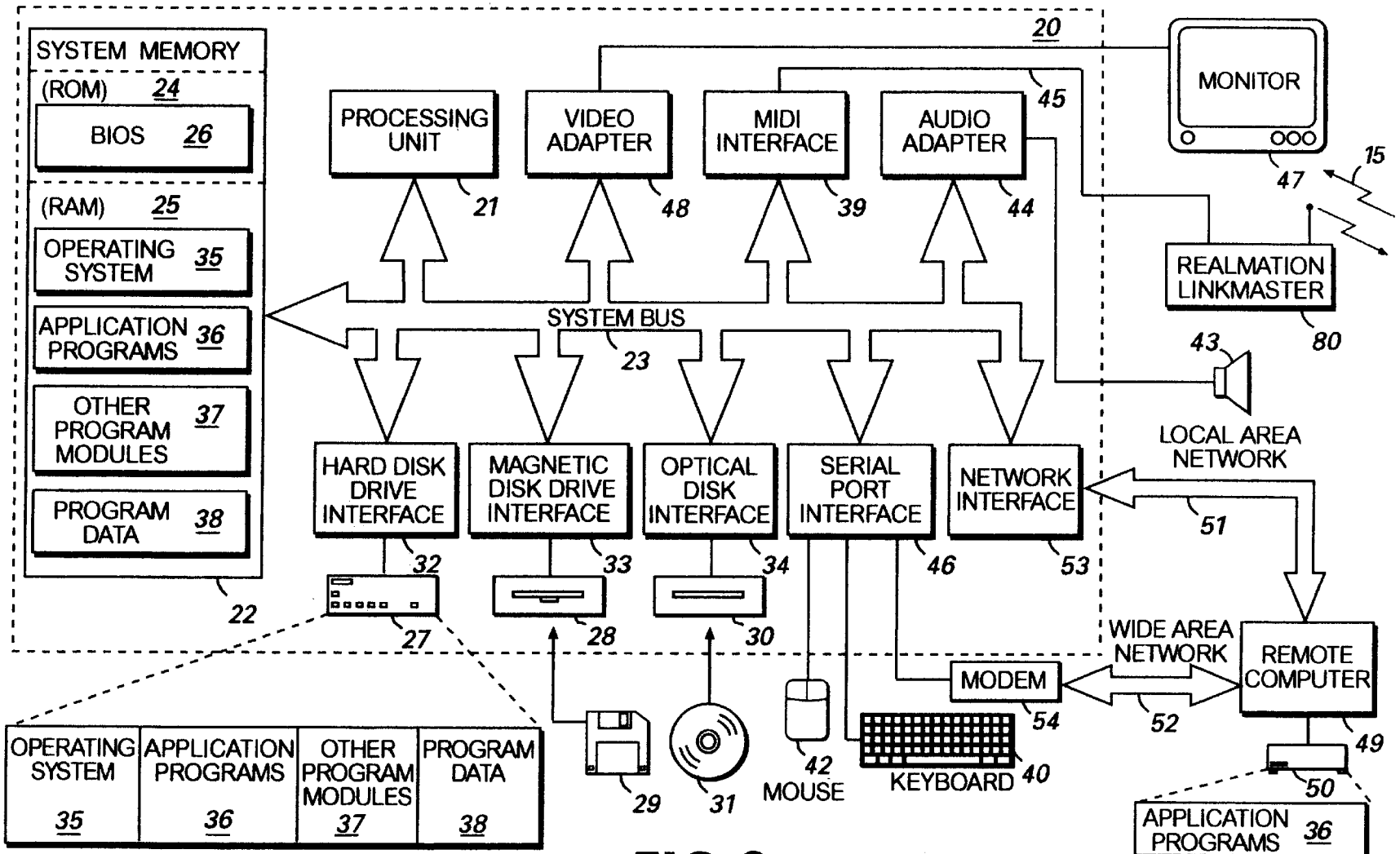
FIG. 2 is an illustration of an exemplary system for implementing a Realmation Control System of the duplex embodiment shown in FIG. 1.

FIG. 2 illustrates an exemplary system for implementing the Realmation Control System 10 of the duplex embodiment. The exemplary system includes a conventional personal computer 20, including a processing unit 21, system memory 22, and a system bus 23 that couples the system memory to the processing unit 21. The system memory 22 includes read only memory (ROM) 24 and random access memory (RAM) 25. The ROM 24 provides storage for a basic input/output system 26 (BIOS) containing the basic routines that help to transfer information between elements within the personal computer 20, such as during start-up. The personal computer 20 further includes a hard disk drive 27, a magnetic disk drive 28 for the purpose of reading from or writing to a removable disk 29, and an optical disk drive 30 for the purpose of reading a CD-ROM disk 31 or reading from or writing to other optical media. The hard disk drive 27, magnetic disk drive 28, and optical disk drive 30 interface to the system bus 23 through a hard disk drive interface 32, a magnetic disk drive interface 33, and an optical drive interface 34, respectively. The drives and their associated computer-readable media provide nonvolatile storage for the personal computer 20. Although the description above of computer-readable media refers to a hard disk, a removable magnetic disk, and a CD-ROM disk, it should be appreciated by those skilled in the art that other types of media which are readable by a computer, such as magnetic cassettes, flash memory cards, digital video disks, Bernoulli cartridges, and the like, may also be used in the exemplary operating environment.

A number of program modules may be stored in drives 27–30 and RAM 25, including an operating system 35, one or more application programs 36, other program modules 37, and program data 38. A user may enter commands and information into the personal computer 20 through a keyboard 40 and pointing device, such as a mouse 42. Other input devices (not shown) may include a microphone, joystick, track ball, light pen, game pad, scanner, camera, or the like. These and other input devices are often connected to the processing unit 21 through a serial port interface 46 that is coupled to the system bus, but may be connected by other interfaces, such as a game port or a universal serial bus (USB). A computer monitor 47 or other type of display device is also connected to the system bus 23 via an interface, such as a video adapter 48. One or more speakers 43 are connected to the system bus via an interface, such as an audio adapter 44. In addition to the monitor and speakers, personal computers typically include other peripheral output devices (not shown), such as printers and plotters.

The personal computer 20 may operate in a networked environment using logical connections to one or more remote computers, such as remote computer 49. Remote computer 49 may be a server, a router, a peer device or other common network node, and typically includes many or all of the elements described relative to the personal computer 20, although only a memory storage device 50 has been illustrated in FIG. 2. The logical connections depicted in FIG. 2 include a local area network (LAN) 51 and a wide area network (WAN) 52. These types of networking environments are commonplace in offices, enterprise-wide computer networks, intranets and the Internet.

When used in a LAN networking environment, the personal computer 20 is connected to the LAN 51 through a network interface 53. When used in a WAN networking environment, the personal computer 20 typically includes a modem 54 or other means for establishing communications over the WAN 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

The personal computer 20 contains a musical instrumentation digital interface ("MIDI") adapter 39 that provides a means for the PU 21 to control a variety of MIDI compatible devices (i.e., electronic keyboards, synthesizers, etc.). The MIDI adapter may also allow the PU 21 to control a Realmation Link Master 80. The MIDI adapter operates by receiving data over the system bus 23, formatting the data in accordance with the MIDI protocol, and transmitting the data over a MIDI bus 45. The equipment attached to the MIDI bus will detect the transmission of the MIDI formatted data and determine if the data is to be ignored, or to be accepted and processed. Thus, the Realmation Link Master 80 examines the data on the MIDI bus and processes data that explicitly identifies the Realmation Link Master 80 as the intended recipient. In response to receiving data, the Realmation Link Master 80 may transmit the data over RF communication channel 15.

Figure 3:
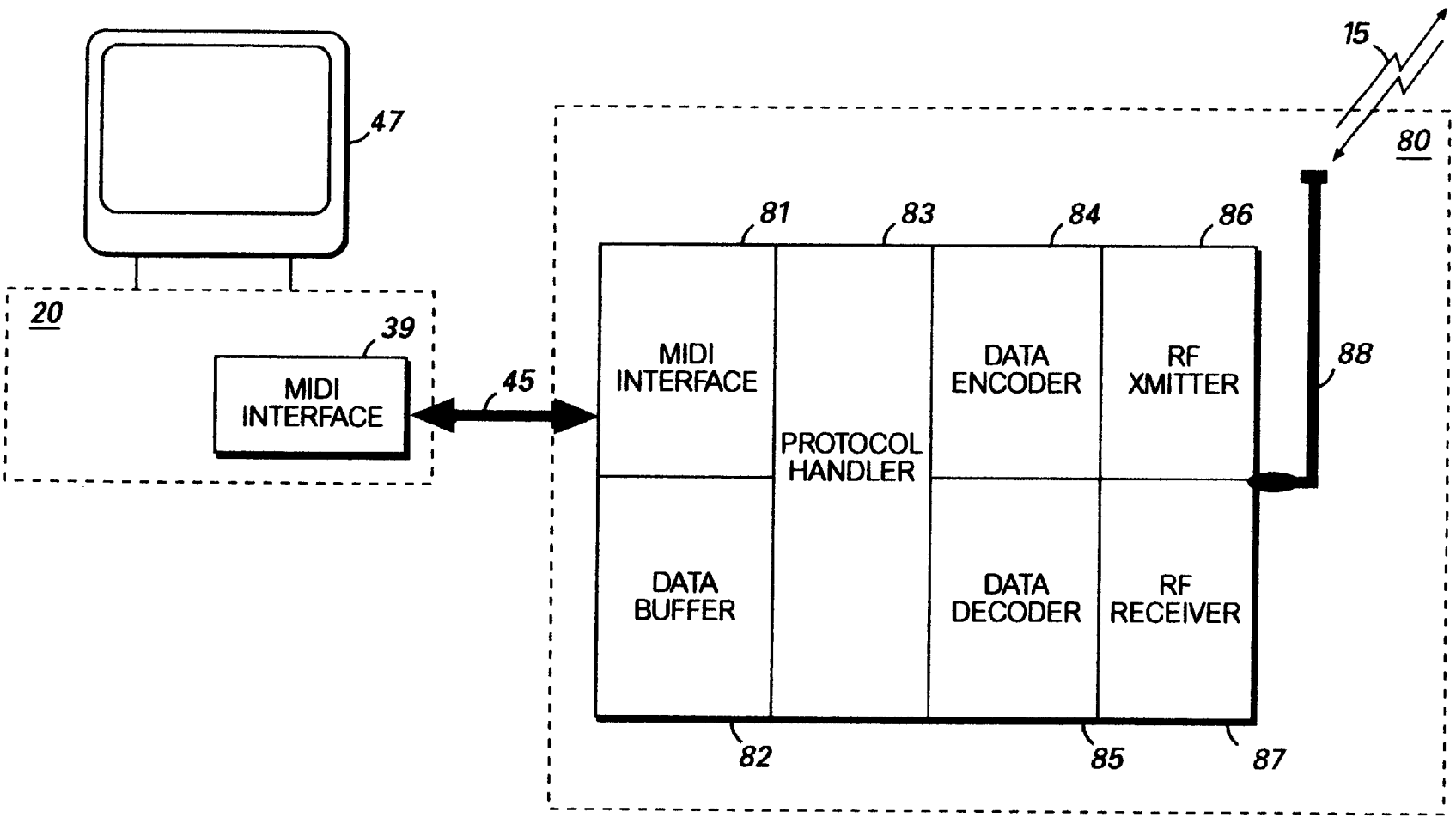
FIG. 3 is a block diagram illustrating the various components and/or processes that define a Realmation Link Master of the duplex embodiment shown in FIG. 1.

FIG. 3 is a block diagram illustrating the various components and/or processes that define the Realmation Link Master 80. Initially, a program running on computer 20 obtains realmation data by generating the data or retrieving the data from a storage media accessible to computer 20. In addition, the program may format the realmation data in accordance with a realmation specific protocol, or, in the alternative, the program may retrieve pre-formatted realmation data from a storage media. The program transfers the realmation data to the Realmation Link Master 80 over the MIDI interface including MIDI adapters 39 and 81 and MIDI bus 45. This process includes repackaging the realmation data into the MIDI format. Those skilled in the art will appreciate that the MIDI interface is only one of several possible interfaces that can be used to transfer realmation data between the computer 20 and the Realmation Link Master 80. Alternative interfaces include, but are not limited to, interfaces such as RS232, Centronix, and SCSI.

The protocol handler 83 receives the MIDI formatted data from the MIDI adapter 81 and removes the MIDI formatting to recover the realmation data. During this process, the protocol handler 83 may temporarily store the realmation data and/or the MIDI formatted data in data buffer 82. The protocol handler 83 may also perform other manipulations on the realmation data in preparation for transmitting the data. Before transmitting the realmation data, the data encoder process 84 encodes the realmation data and provides the encoded realmation data to the RF transmitter 86. The RF transmitter uses the encoded realmation data to modulate a carrier and then transmits the modulated carrier from antenna 88 to Realmation Performer 60 (FIG. 4) over RF communications channel 15.

The Realmation Link Master 80 may also receive signals carrying realmation data from one or more Realmation Performers 60 or other devices. The Realmation Link Master 80 detects these signals at antenna 88 and provides the signals to the RF receiver 87. The RF receiver 87 demodulates the received signals, recovers encoded realmation data and provides the encoded realmation data to the data decoder process 85. The data decoder process 85 decodes the encoded realmation data, and provides decoded realmation data to the protocol handler 83. The protocol handler 83 packages the decoded realmation data into the MIDI format and transfers the MIDI formatted data to computer 20 through MIDI interface 81. The protocol handler 83 and or the MIDI interface 81 may temporarily store the realmation data in data buffer 82 during processing.

Upon receiving the information at the MIDI Interface 39, the computer 20 recovers the realmation data from the MIDI formatted data and then processes the realmation data.

Simplex Embodiment: Video Signal-Based System

Figure 4:
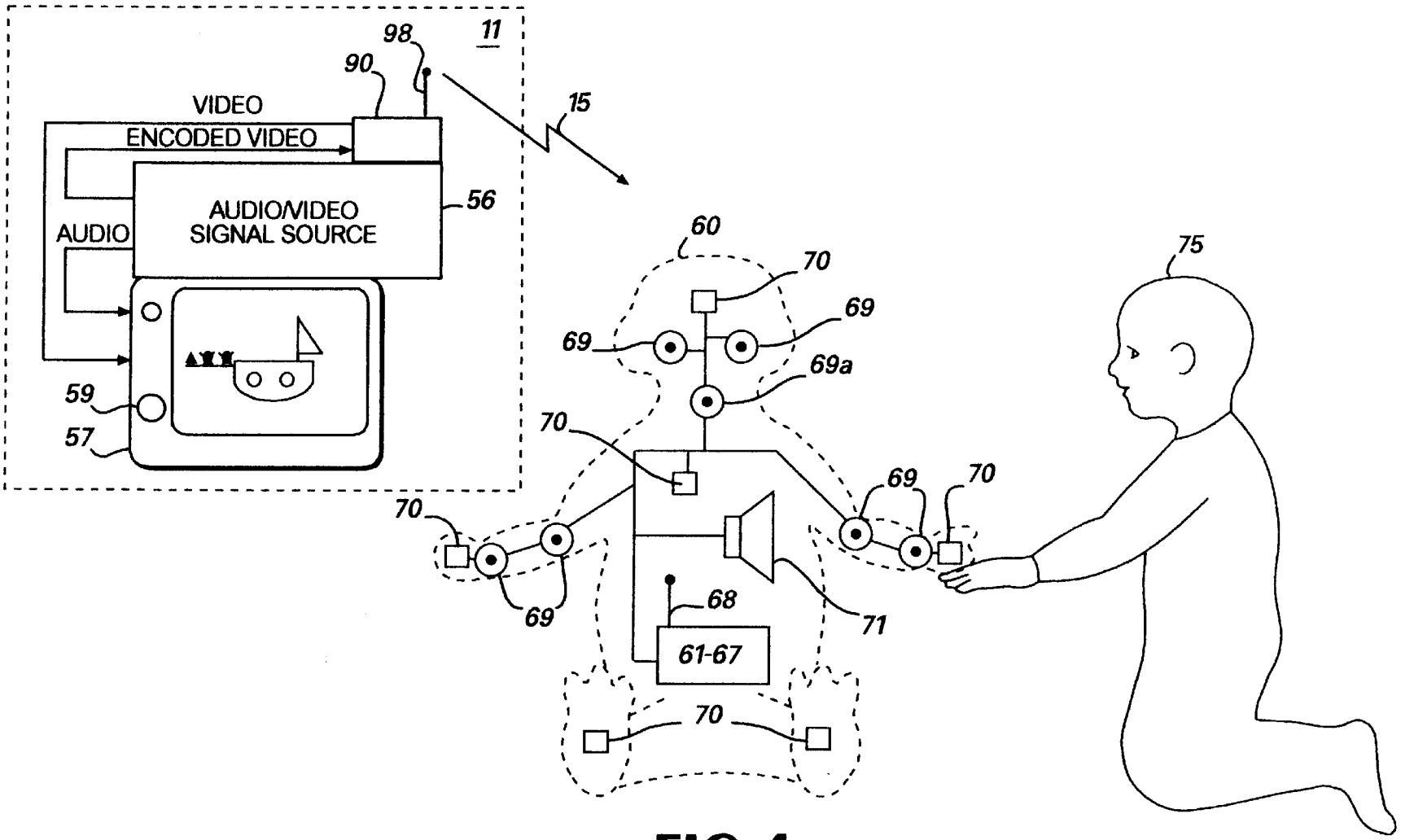
FIG. 4 is an illustration of an exemplary environment for a simplex embodiment of the present invention.

FIG. 4 illustrates an exemplary environment for a simplex embodiment of the present invention. This environment provides a child with a learning setting that includes a Realmation Control System 11 that controls a Realmation Performer 60. The Realmation Control System 11 includes an audio/video signal source 56, a Realmation Link Master 90, an antenna 98, and a display device 57 including a speaker 59. The Realmation Control System 11 transmits realmation data to the Realmation Performer 60 by means of antenna 98 and an RF communication channel 15. To accomplish this task, the Realmation Link Master 90 interfaces with the audio/video signal source 56 and display device 57 through a standard video connection. Over this standard video interface, the Realmation Link Master 90 receives a video signal encoded with realmation data ("Encoded Video") from the audio/video signal source 56. The Realmation Link Master 90 strips the realmation data from the video signal and then transfers the realmation data to a Realmation Performer 60 through a RF communication channel 15. In addition, the Realmation Link Master 90 passes the stripped video signal ("Video") to the display device 57. The audio/video signal source 56 also interfaces with speaker 59 in the display device 57. Over this interface, the audio/video signal source 56 provides audio signals for an audio/video presentation. Thus, a child can observe the audio/video presentation on display device 56 and speaker 59 while the Realmation Link Master 90 transmits realmation data to one or more Realmation Performers 60. The reception of the realmation data causes the Realmation Performer 60 to move and talk as though it is an extension of the audio/video presentation.

Figure 5:
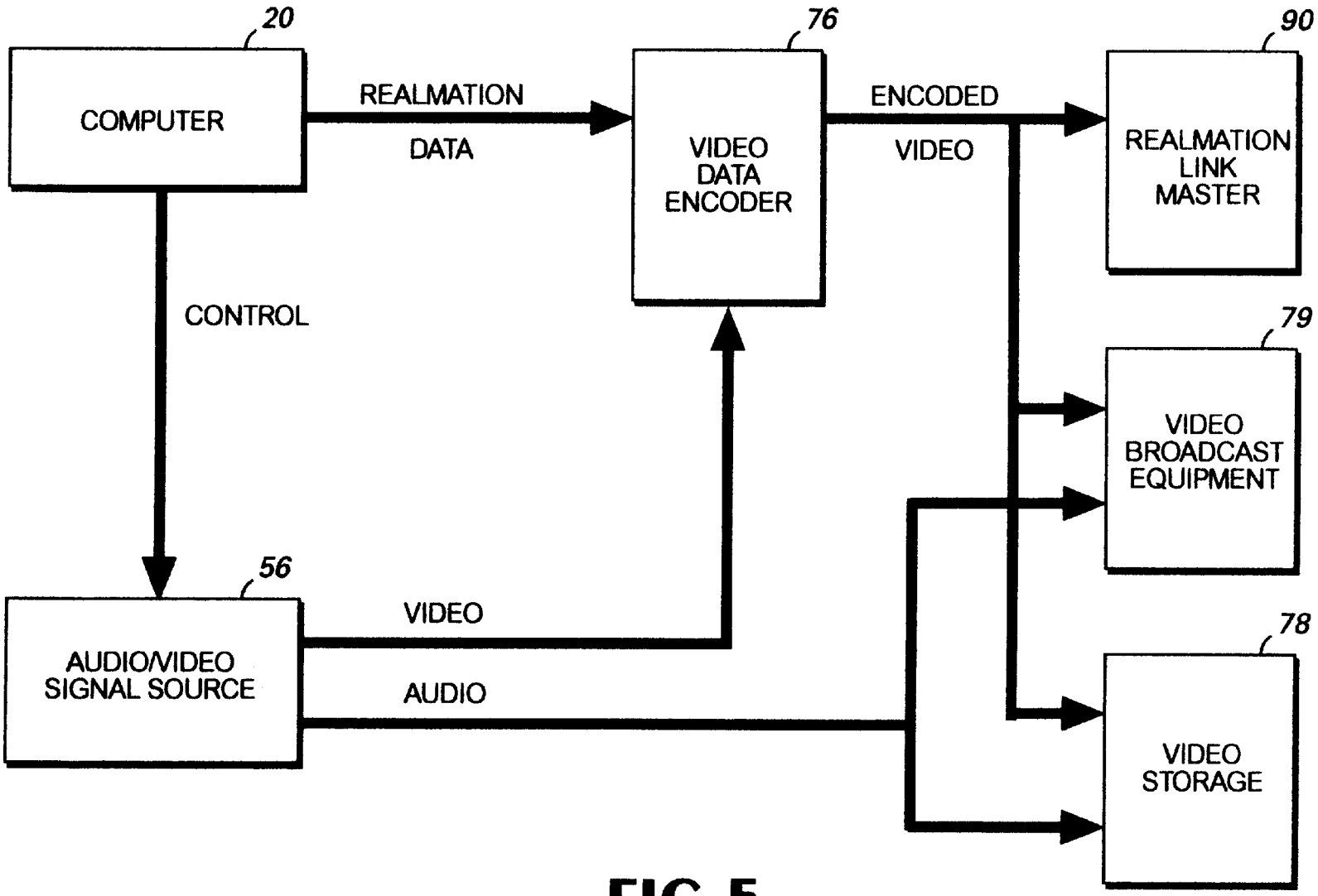
FIG. 5 is a block diagram illustrating a paradigmatic system that generates a video signal encoded with realmation data.

A variety of sources including, but not limited to, a video cassette recorder or player, a cable reception box, a TV tuner, a laser disc player, a satellite broadcast, microwave broadcast, or a computer with a video output, may provide the Encoded Video. FIG. 5 is a block diagram illustrating a paradigmatic system that generates a video signal encoded with realmation data. In FIG. 5, computer system 20 interfaces with a video data encoder 76 and an audio/video signal source 56. The audio/video signal source 56 provides two output signals: Video and Audio. These output signals may include live camera feeds, pre-recorded playbacks, broadcast reception, etc. The computer system 20 controls the operation of 15 the audio/video source 56 by means of a control signal ("Control"). The Control signal gates the output of the Video and Audio signals from the audio/video signal source 56.

The computer system 20 also provides realmation data for encoding onto the Video signal. The computer system 20 transfers the realmation data and gates the Video signal to the video data encoder 76. The video data encoder combines the Video signal and the realmation data by encoding the realmation data onto the video signal and generating a realmation encoded video signal ("Encoded Video"). This encoding technique includes modulating the luminance of the horizontal overscan area of the Video signal on a line-by-line bases. This technique results in encoding each line with a single realmation data bit. Furthermore, the field boundaries of the Video signal provide a framing structure for the realmation data, with each frame containing a fixed number of data words.

More specifically, each field of the Video signal contains a pattern identification word consisting of four bits. The value of the four bit pattern identification word in each contiguous field cyclically sequences through a defined set of values. The pattern identification word in each field distinguishes an Encoded Video signal from a normal Video signal. In a normal Video signal, random "noise" appears in place of the pattern identification word. A decoder attempting to recover realmation data from an Encoded Video signal must detect the presence of the pattern. Thus, the pattern identification word provides an additional layer of integrity to the recovered realmation data beyond that of simple checksum error detection.

A Realmation Link Master 90 receiving the Encoded Video signal from the audio/video signal source 56, may recover the realmation data from the Encoded Video signal, and then transmit the realmation data to a Realmation Performer 60 (shown in FIG. 4). Alternatively, video broadcast equipment 79 may receive the Encoded Video signal along with the Audio signal and then broadcast the signals to one or more remotely located Realmation Link Masters. In another alternative, video storage equipment 78 may receive the Encoded Video signal along with the Audio signal and then store the signals onto a storage medium for future retrieval.

Figure 6:
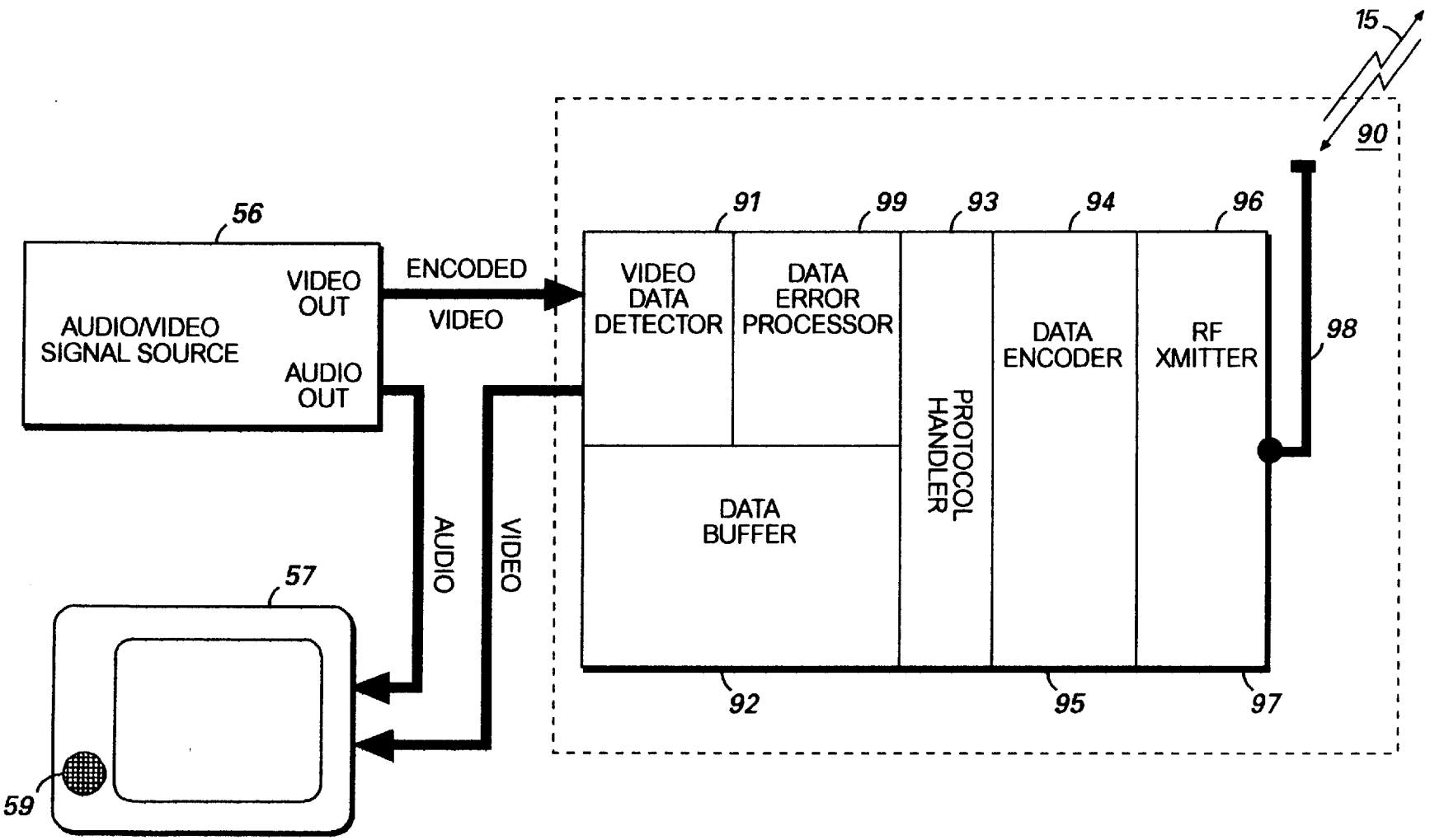
FIG. 6 is a block diagram illustrating the various components and/or processes that define a Realmation Link Master of the simplex embodiment shown in FIG. 4.

FIG. 6 is a block diagram illustrating the various components and/or processes that define the Realmation Link Master 90. Each of the components of the Realmation Link Master 90 may be implemented in hardware, software or a combination of both. The video data detector 91 of the Realmation Link Master 90 receives a video signal, originating from an audio/video signal source 56, and identifies whether the video signal is an Encoded Video signal. If the video data detector 91 detects the presence of the pattern identification word in the received video signal, then the video signal is an Encoded Video signal. The video data detector 91 then proceeds to remove the realmation data from the Encoded Video signal and provides the realmation data to the data error processor 99 while providing a non-encoded video signal to the display device 57.

The data error processor 99 analyzes the realmation data to detect and correct any errors that may exist in the realmation data. After any errors in the realmation data are corrected, the protocol handler 93 receives the recovered and verified realmation data and assembles message packets for transmitting to one or more Realmation Performers 60. Upon assembling a message packet, the protocol handler 93 provides the message packet to the data encoder 94. The data encoder 94 encodes the data and provides the encoded data to RF transmitter 96. The RF transmitter 96 receives the encoded data and modulates a carrier signal with the encoded data. Furthermore, the RF transmitter transmits the modulated carrier through antenna 98. During processing of the realmation data, the various components may temporarily store the realmation data in data buffer 92.

The display device 57 receives the non-encoded video signal from the video data detector 91 and an audio signal from the audio/video signal source 56. The reception of these signals results in an audio/video presentation on display device 57 and speaker 59.

It should be understood that a relationship exists between the audio/video presentation on display device 57 and the realmation data that is transmitted from antenna 98. Although the processes of detecting the realmation data, correcting any errors, encoding the realmation data, and then modulating a carrier may introduce a slight delay, the Video signal received by the display device 57 and the realmation data transmitted from antenna 98 were obtained from the same area of the original Encoded Video signal. This characteristic allows for the encoding of context-sensitive realmation data onto the video signal. Transmitting context-sensitive realmation data to one or more Realmation Performers allows the Realmation Performers to move and/or talk in a manner that relates to the audio/video presentation.

Realmation Performer

Figure 7:
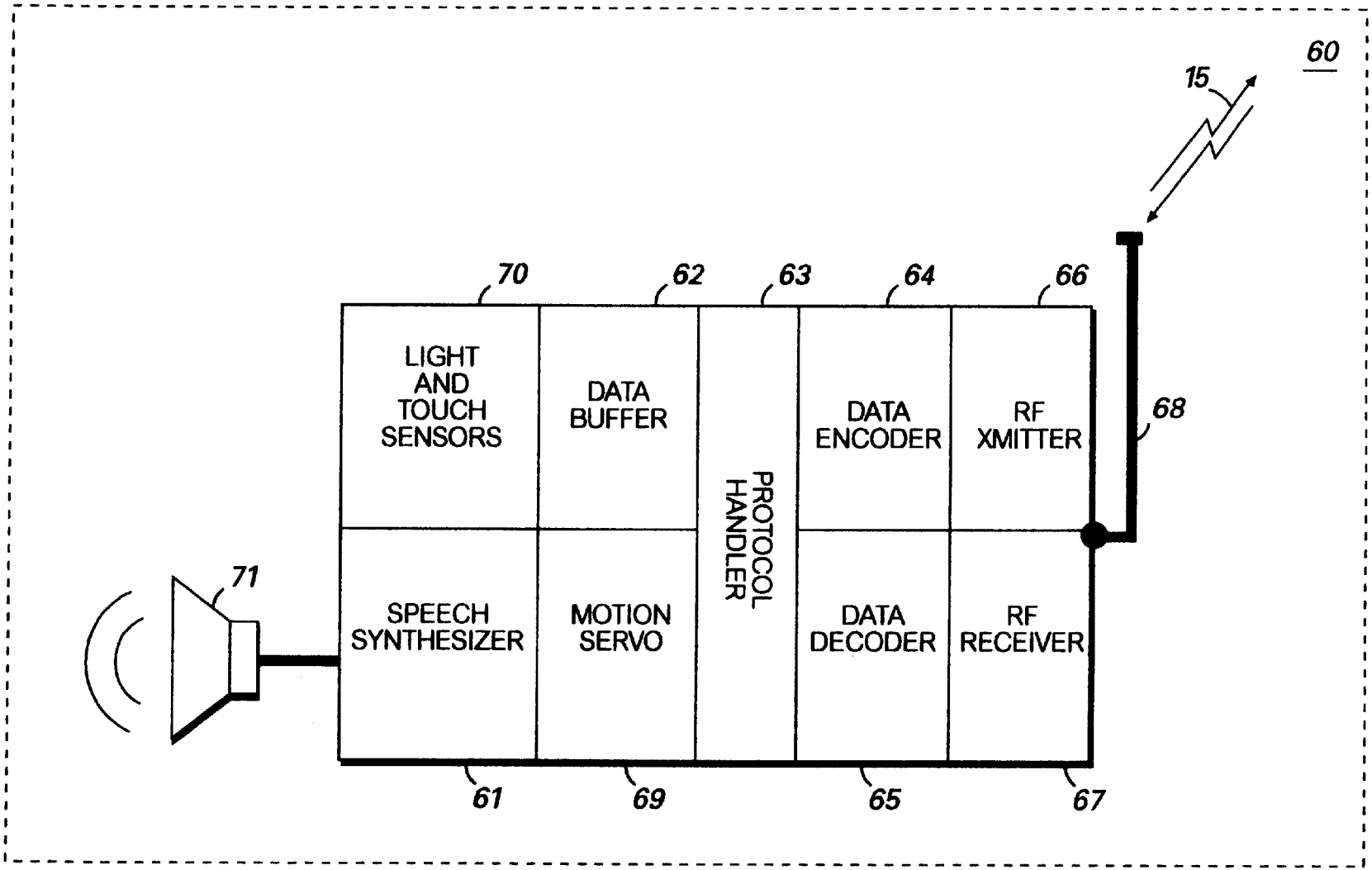
FIG. 7 is a functional block diagram illustrating the various components and/or processes that define a Realmation Performer in accordance with an exemplary embodiment of the present invention.

FIG. 7 is a functional block diagram illustrating the various components and/or processes that define a Realmation Performer 60. Each of these components may be implemented in hardware, software or a combination of both. Generally, the Realmation Performer includes a microprocessor or other processing unit for retrieving a program from ROM, or some other non-volatile storage media, and executing the instructions of the program. In addition, the Realmation Performer 60 includes hardware components such as an RF radio receiver 67 and possibly a transmitter 66, an antenna 68, a readable and writable storage memory 62, sensors 70, servo motors 69, a speech synthesizer 61, and a speaker 71.

The RF receiver 67 receives detected signals from antenna 68. The RF receiver operates on the received signal by demodulating the carrier and recovering encoded realmation data. Next, the data decoder 65 receives and decodes the encoded realmation data. The protocol handler 63 receives the decoded realmation data output from the decoder 65 and interprets the realmation data. Based on the content of the realmation data, the program sends control signals and/or speech data to the appropriate devices. Thus, if the realmation data contains control information, one or more of the motion servo motors 69 will receive control signals causing them to be actuated. Furthermore, if the realmation data contains speech data, the speech synthesizer 61 will receive the speech data, convert the speech data into audio signals, and then provide the audio signals to the speaker 71. The realmation data may be temporarily stored in data buffer 62 while various processes are being performed.

The Realmation Performer 60 may also include light sensors and touch sensors 70. The sensors 70 may generate status information in response to variations in pressure, light, temperature or other parameters. The Realmation Performer 60 may transmit this status information to the Realmation Control System 10 (shown in FIG. 1). This process includes formatting the status information in protocol handler 63, encoding the status information in data encoder process 64, modulating a carrier with the encoded status information in RF transmitter 66, and then transmitting the modulated carrier over RF communications path 15 through antenna 68.

Human Speech Production

Before proceeding with a description of the present invention, it will prove useful to provide a brief background on human speech production. The phonatory and articulatory mechanisms of speech may be regarded as an acoustical system whose properties are comparable to those of a tube of varying cross-sectional dimensions. At the lower end of the tube, or the vocal tract, is the opening between the vocal cords, also known as the glottis. The upper end of the vocal tract ends at the lips. The vocal tract consists of the pharynx (the connection from the esophagus to the mouth) and the mouth or oral cavity.

In studying the speech production process, it is helpful to abstract the important features of the physical system in a manner which leads to a realistic, yet tractable, mathematical model. The sub-glottal system comprises the lungs, bronchi and trachea. This sub-glottal system serves as a source of energy for the production of speech. Speech is simply the acoustic wave that is radiated from this system when air is expelled from the lungs and the resulting flow of air is perturbed by a constriction somewhere in the vocal tract.

Speech sounds can be classified into three distinct classes according to their mode of excitation. The present invention uses two of these classes, voiced and unvoiced, along with other parameters to determine the proper lip position and mouth opening of an animated or mechanical character. Voiced sounds are produced by forcing air through the glottis with the tension of the vocal cords adjusted so that they vibrate in a relaxation oscillation, thereby producing quasi-periodic pulses of air which excite the vocal tract. Almost all of the vowel sounds and some of the consonants of English are voiced.

Unvoiced sounds are produced by forming a constriction at some point in the vocal tract, usually toward the mouth end, and forcing air through the constriction at a high enough velocity to produce turbulence. Examples of unvoiced sounds are the consonants in the words hat, cap and sash. During whispering, all sounds produced are unvoiced.

Determining Lip Position and Mouth Opening

Briefly described, the present invention provides a system for determining the mouth features, i.e., the lip position and mouth opening, of a speaking animated or mechanical character. Lip position will be used to refer to the shape and position of the lips of the animated or mechanical character. For instance, for a human being to pronounce different sounds, such as different vowels and consonants, the speaker's lips must be placed in different shapes or positions. The present invention can determine the lip position, or shape of the lips, which is necessary to pronounce the sound that the animated or mechanical character is speaking.

Mouth opening will be used to refer to the amount of opening between the lips of the animated or mechanical character. For instance, a human being who is speaking loudly generally has a larger opening between his lips than one who is whispering. It is this understanding that underlies the determination of mouth opening. Thus, the present invention also provides a method for determining the amount of opening between the lips that is necessary to produce the sound that the animated or mechanical character is speaking. By combining lip position and mouth opening, the present invention determines the mouth features necessary to provide a realistic synchronization between a speaking animated or mechanical character and the speech that the character is speaking.

Those skilled in the art will appreciate that the present invention is a computer-implemented process that is carried out by the computer in response to instructions provided by a program module. In one embodiment, the program module that executes the process is implemented on computer 20 (FIG. 1). However, in other embodiments, such as the simplex embodiment described above with respect to FIG. 4, the program module that executes the process may be implemented in Realmation Link Master 90 (FIG. 4) or Realmation Performer 60 (FIG. 4). In these embodiments, either the Realmation Link Master 90 or Realmation Performer 60 includes an applicable computer (not shown) to execute the instructions provided by the program module.

Figure 8:
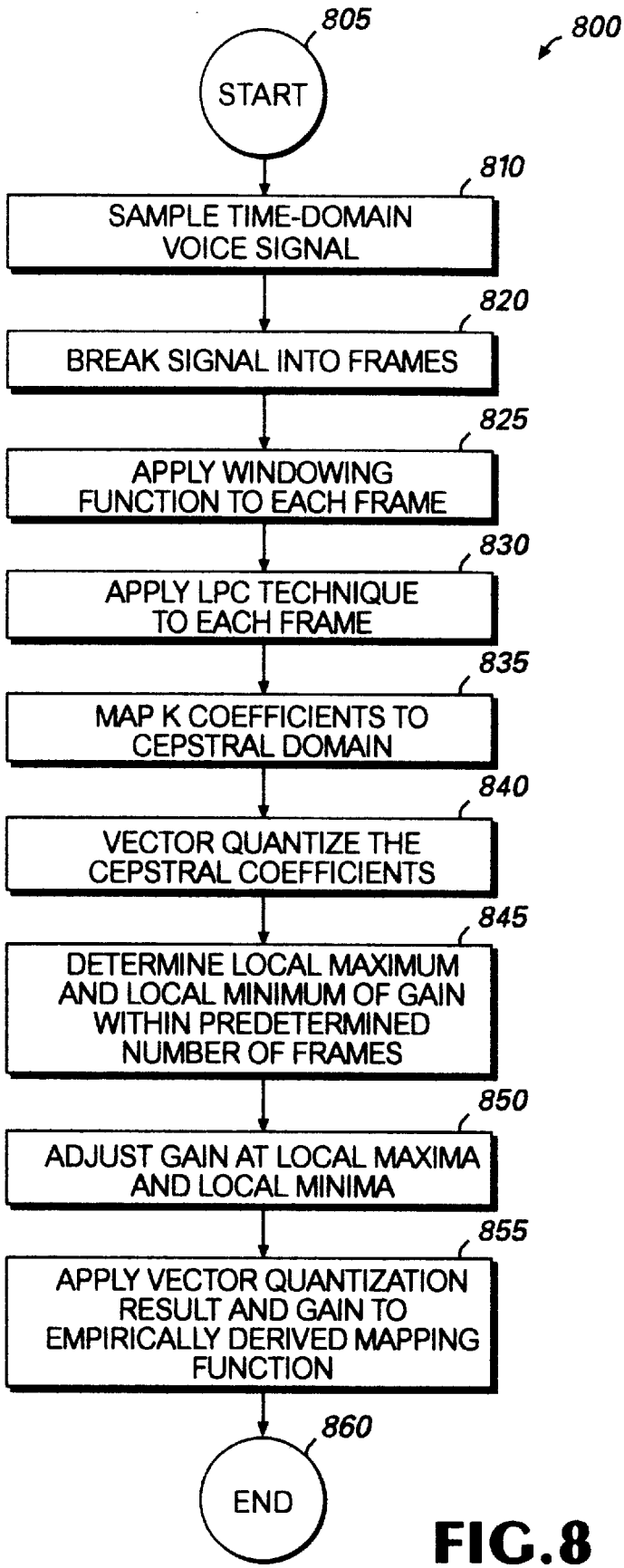
FIG. 8 is a flow diagram illustrating a method for determining mouth features in accordance with an exemplary embodiment of the present invention.

Turning now to FIG. 8, a flow diagram illustrating a method 800 for determining lip position and mouth opening for an animated or mechanical character in accordance with an exemplary embodiment of the present invention is shown. The method 800 begins at start step 805 and proceeds to step 810 where a time-domain voice signal is digitally sampled, or digitally recorded. Preferably, the voice signal is sampled at the CD-quality sampling rate of 44.1 kHz with a sampling precision of 16 bits. It should be understood that, although 44.1 kHz is the preferred sampling rate and 16 bits is the preferred sampling precision, other sampling rates and sampling precisions may be used.

In one embodiment, the time-domain voice signal corresponds to the words or sounds that are to be spoken, sung, or otherwise produced by Realmation Performer 60 (FIGS. 1 and 4). In yet another embodiment, the time-domain signal corresponds to the words or sounds that are to be spoken, sung, or otherwise produced by an animated character displayed on display device 47 (FIG. 1). It should also be recognized by those skilled in the art that, in alternative embodiments, the time-domain signal may correspond to the words or sounds that are to be spoken, sung, or otherwise produced by other animated or mechanical characters not shown in the previously described figures.

Figure 9A:
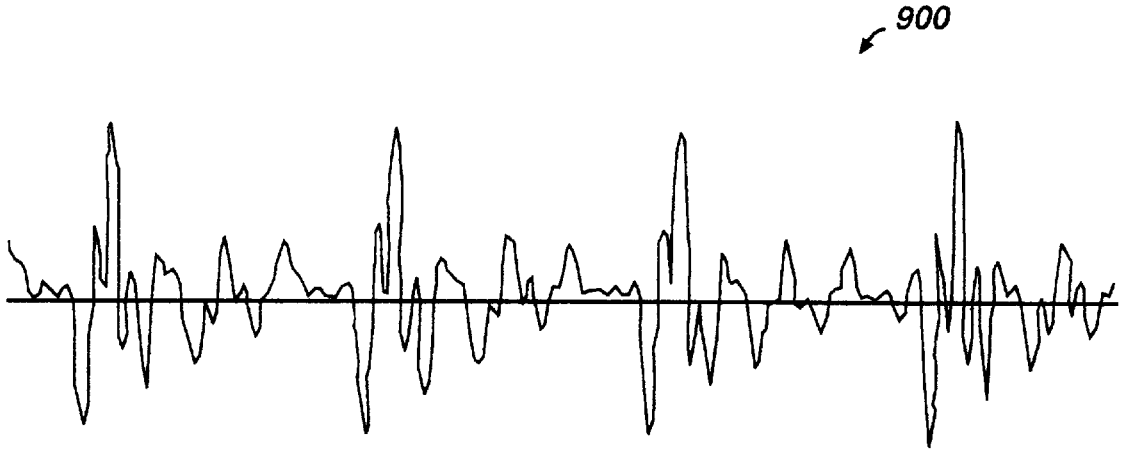
FIG. 9A is an illustration of a typical time-domain voice signal.
Figure 9B:
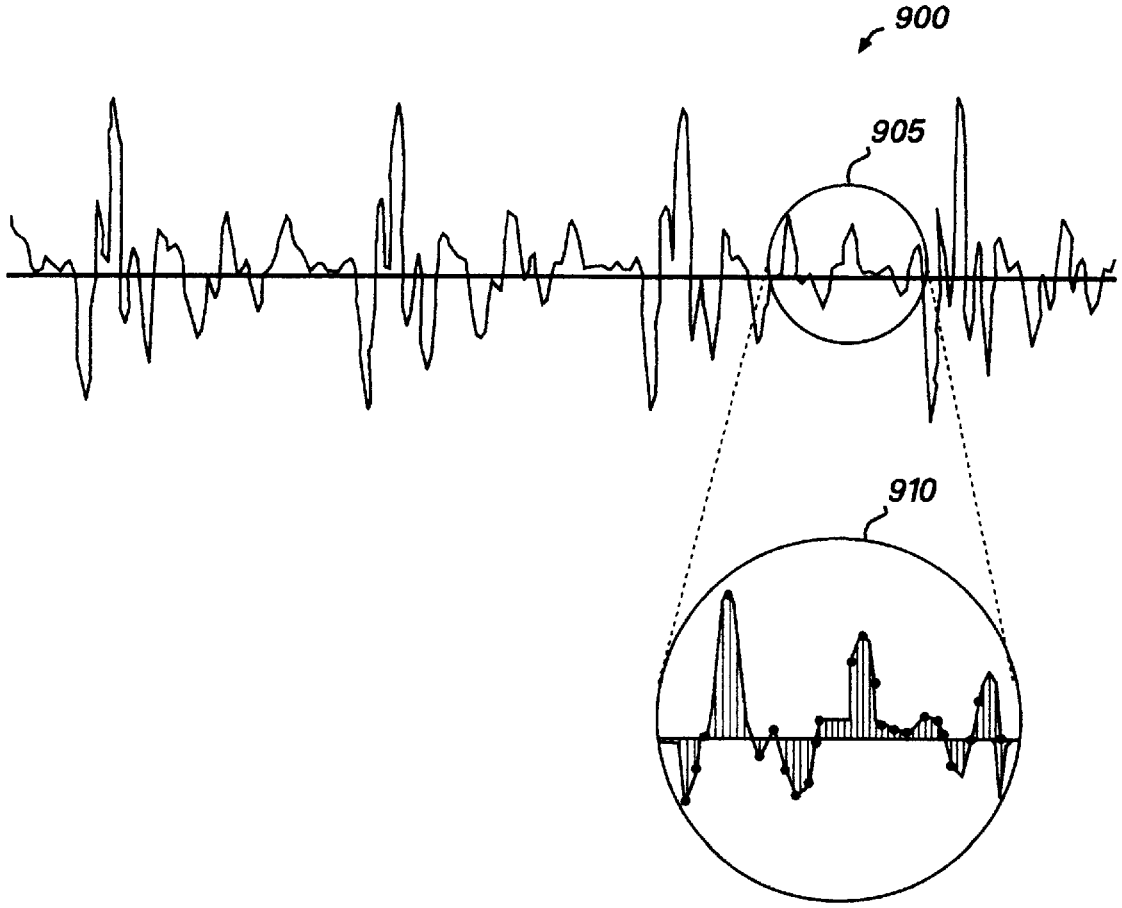
FIG. 9B is an illustration of a typical time-domain voice signal including an enlarged portion that has been digitally sampled.

Referring now to FIGS. 9A and 9B, a brief overview of digitally sampling a time-domain voice signal will be provided. FIG. 9A is an illustration of a typical time-domain voice signal 900. The x-axis is representative of time and the y-axis is representative of fluctuations of acoustic pressure. As seen in FIG. 9A, as a sound is produced, the acoustic pressure at the speaker's mouth changes over time resulting in an acoustic wave, or sound wave. FIG. 9B is an illustration of a typical time-domain voice signal 900 in which a portion 905 has been enlarged and is shown as enlarged portion 910. The enlarged portion 910 illustrates the manner in which the time-domain voice signal 900 is digitally sampled. Each digital sample is represented in enlarged portion 910 by a vertical line ending in a black dot. Thus, as can be extrapolated from FIG. 9B, as the sampling rate increases, the number of samples for the time-domain voice signal increases which results in a more accurate digital representation of the original time-domain voice signal.

The sampled voice signal from step 810 is divided, or broken, into frames at step 820. Each frame contains the digital samples for a specific period of time. Preferably, each frame is twenty milliseconds in length. Thus, for example, if the resampled voice signal is 2 seconds long and each frame is 20 milliseconds in length, then the number of frames is equal to 2 seconds divided by 20 milliseconds, or 100 frames. As is known to those skilled in the art, the underlying assumption in most speech processing schemes is that the properties of a speech signal change relatively slowly with time. This assumption leads to a variety of processing methods in which short segments, or frames, are isolated and processed as if they were short segments from a sustained sound with fixed properties. Thus, the resampled voice signal is divided into frames at step 820 so that the signal can be further processed to provide an accurate representation of lip position and mouth opening as will be further described.

Figure 9C:
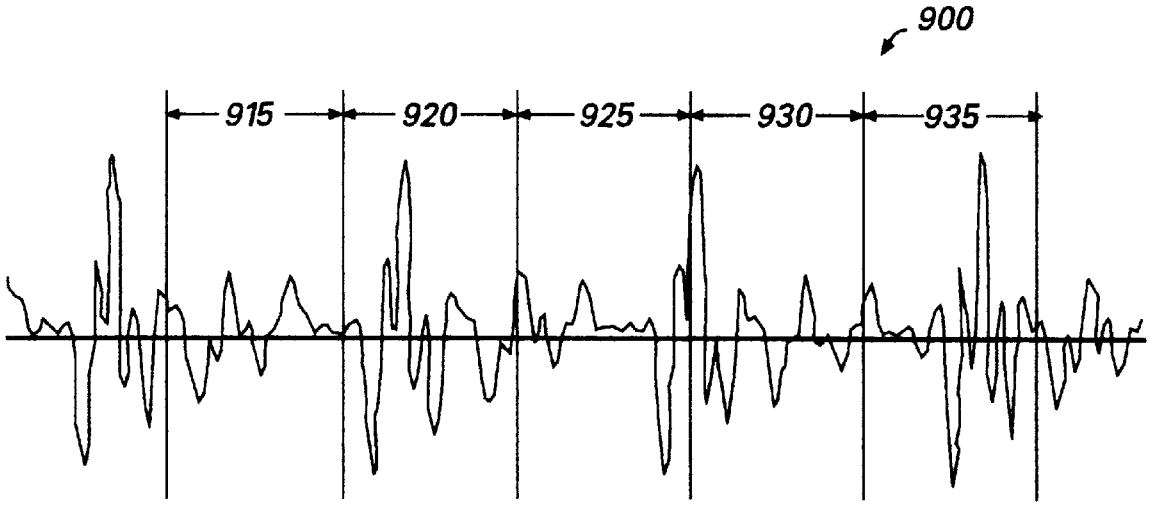
FIG. 9C is an illustration of a time-domain signal divided into frames.

Referring now to FIG. 9C, an illustration of a time-domain signal 900 divided into frames is shown. Frames 915, 920, 925, 930, and 935 are illustrative of some of the frames that may be generated when the time-domain signal 900 is broken into frames at step 820. Although FIG. 9C illustrates an analog voice signal, it should be recognized that the resampled voice signal that is divided, or broken, into frames at step 820 is actually composed of digital samples such as is illustrated in the enlarged portion 910 of FIG. 9B.

Referring again to FIG. 8, a windowing function is applied to each frame of the resampled voice signal at step 825. A windowing function is a digital speech processing technique that is well-known to those skilled in the art. The windowing function is applied to each frame at step 825 to de-emphasize the effects of the boundary conditions of each frame. Preferably, the digital samples in the middle of the frame are unaffected by the windowing function, while the samples near the edges of the frame are attenuated to de-emphasize these samples. A Hamming window is preferably the windowing function applied at step 825. However, it should be understood that other types of digital speech processing windowing functions could be applied at step 825, such as, but not limited to, a Hanning windowing function or a triangular windowing function.

After the windowing function has been applied to each of the frames at step 825, then a linear predictive coding (LPC) technique is applied to each of the frames at step 830. LPC techniques result in a compressed form of human speech that models the vocal chords of a human being and the way that a human being produces sounds. As part of applying a LPC technique to the frames at step 830, a number of attributes are determined for each frame. These attributes include a gain, or power, of the voice signal frame. The attributes also include a number of k coefficients, or reflection coefficients. The k coefficients include a pitch coefficient and a voiced/nonvoiced coefficient. LPC techniques, along with the attributes that are determined through LPC techniques, are well-known to those skilled in the art of speech recognition.

The power, or gain, is determined for each frame. The power is an indication of the amount of air that is being dispersed as the word or syllable is being spoken. Power is a good approximation of the mouth opening because, generally, as the power increases, the amount of opening between the lips increases. It should be understood by those skilled in the art that there are many ways to determine gain, including, but not limited to, the root-mean-square (RMS) method and the prediction error method.

The pitch coefficient may be determined using one of several different correlation methods. The most popular of these methods is average magnitude difference function (AMDF), but those skilled in the art will be able to choose other functions. The correlation results may be used to determine whether a segment of speech is voiced or unvoiced. High auto-correlation of the signal means that the segment is voiced. Lower auto-correlation means the segment is unvoiced.

At step 835, the k coefficients determined at step 830 for each frame are mapped to the Cepstral domain resulting in a number of Cepstral coefficients for each frame. Mapping from the LPC domain to the Cepstral domain is well-known to those skilled in the art of speech recognition. The k coefficients are mapped to the Cepstral domain because k coefficients do not map well to what is being heard by an observer. The k coefficients model the cross-sectional area of the human vocal tract. Thus, k coefficients are effective in speech recognition, i.e., replicating speech, but are not as effective for determining lip position and mouth opening. On the other hand, Cepstral coefficients provide a model for how a human being's voice is being projected and how a human being's voice is heard by others. Thus, Cepstral coefficients provide a better model for a speaker's lip position. The gain for each frame, determined at step 830, remains unchanged.

At step 840, the Cepstral coefficients determined at step 835 for each frame are vector quantized to achieve a vector quantization result for each frame. The vector quantization result corresponds to the character's lip position for each frame. Vector quantization techniques are well-known to those skilled in the art. The vector quantization at step 840 can be accomplished using neural networks, minimum distance mapping or other techniques well-known to those skilled in the art.

Figure 10:
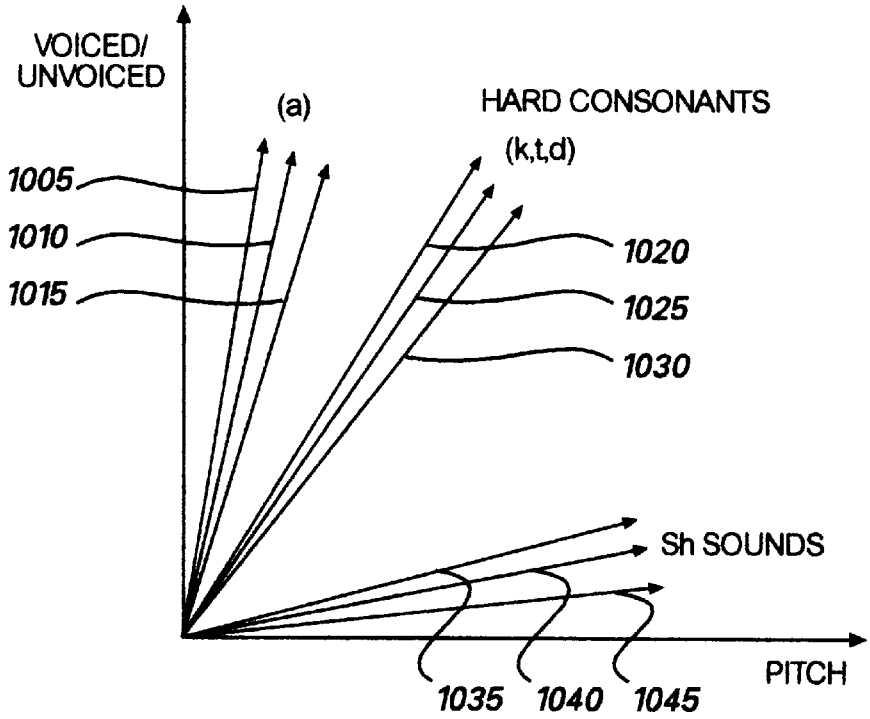
FIG. 10 is an illustration of a vector quantization technique utilizing Cepstral coefficients representing a voiced/nonvoiced coefficient and a pitch coefficient.

Referring to FIG. 10, a representative example of vector quantization, such as is accomplished at step 840, will be discussed. FIG. 10 is an illustration of a vector quantization technique utilizing the Cepstral coefficients representing the voiced/nonvoiced coefficient and the pitch coefficient. The x-axis in FIG. 10 is representative of the pitch coefficient and the y-axis is representative of the voiced/nonvoiced coefficient. As shown in FIG. 10, vectors 1005, 1010 and 1015 have been mapped based upon the pitch coefficient and voiced/nonvoiced coefficient for these frames. Thus, vector 1005 corresponds to the voiced/unvoiced coefficient and pitch coefficient for a frame. Similarly, vectors 1010 and 1015 each correspond to the voiced/unvoiced coefficient and pitch coefficient for a frame. Through vector quantization, a mapped vector can be quantized, or translated, into a corresponding vector quantization result based upon the mapping of the vector. Although in FIG. 10 the mapping and vector quantization is shown using a voice/unvoiced coefficient and a pitch coefficient, those skilled in the art will recognize that any number of different coefficients can be mapped and vector quantized. In addition, vector quantization can be used to determine parameters other than lip position. For instance, vector quantization may be used to determine the sound that is being produced, which is helpful in speech recognition applications. However, for the present invention, the vector quantization result corresponds to the lip position of the animated or mechanical character for each frame.

Vector quantization can be accomplished by minimum distance mapping, by using a neural network (both of which are well-known techniques), or by using another known vector quantization technique. As shown in FIG. 10, through vector quantization, it is determined that the vectors 1005, 1010 and 1015 correspond to the sound produced when speaking the letter "a", because, in this example, these vectors are closest to the range of vectors that are produced when speaking the letter "a". Thus, for the frames that correspond to vectors 1005, 1010 and 1015, it has been determined that the lips of the animated or mechanical character must be placed in the position that would produce the sound of the letter "a". In a similar fashion to that described above, vectors 1020, 1025 and 1030 are determined to correspond to the sound produced when speaking one of the hard consonants, such as "k", "t" or "d". Similarly, vectors 1035, 1040 and 1045 are determined to correspond to the sound produced when speaking a "sh" sound. Thus, it can be seen that through vector quantization the lip position of the animated or mechanical character can be determined at step 840. However, the lip position of the character is only part of the mouth features. The mouth features of a character also includes the mouth opening which corresponds to the gain determined at step 830 as a result of applying the LPC technique. However, the gain determined at step 830 needs to be further processed to produce a smooth speech pattern for the animated or mechanical character as will be further described.

Figure 12A:
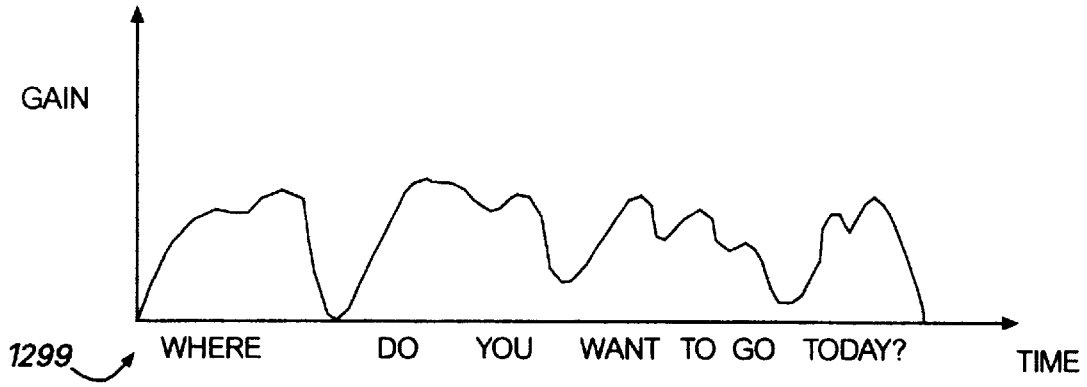
FIG. 12A is an illustration of the gain coefficient of an example phrase plotted over time.
Figure 12B:
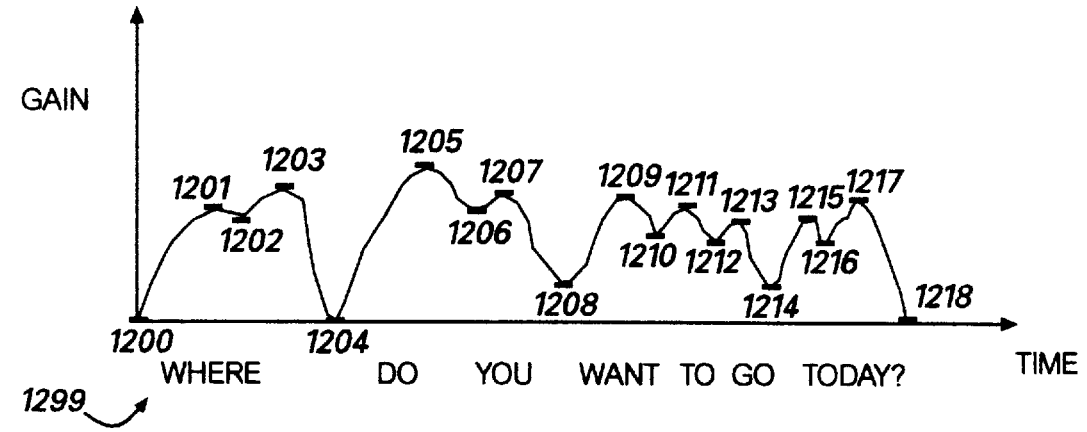
FIG. 12B is an illustration of the gain coefficient of an example phrase plotted over time in which the local minima and local maxima are shown.

The gain coefficient was calculated from frames of an example phrase 1299 and plotted over time in FIG. 12A. Referring again to FIG. 8, at step 845, a local maximum and a local minimum of the gain are found within a predetermined number of frames. Referring now to FIG. 12B, local maxima 1201, 1203, 1205, 1207, 1209, 1211, 1213, 1215 and 1217 are found. Local minima 1200, 1202, 1204, 1206, 1208, 1210, 1212, 1214, 1216 and 1218 are found. All frames containing a local maximum and a local minimum of the gain under a minimal amount of time will be discarded at step 845. For example, referring to FIG. 12C, local maxima 1201 and 1215 have been discarded and local minima 1202 and 1216 have been discarded.

The gain for the frames containing the local minima and the gain for the frames containing the local maxima are adjusted at step 850. The gain for the frames that contain the local minima are adjusted such that the adjusted gain causes the mouth of the character to be fully closed at the local minima. An adjusted gain is also determined for the frames that contains the local maxima such that the adjusted gain causes the mouth of the character to be fully open for the frames that contain the local maxima. For all the remaining frames, i.e., the frames that do not contain a local minimum or local maximum of gain, the gain is scaled between the minimum and maximum gain levels from the values calculated at step 830. For example, referring to FIG. 12C, local maxima 1203, 1205, 1207, 1209, 1211, and 1217 have been adjusted to maximum gain level 1250. Local minima 1200, 1204, 1206, 1208, 1210, 1212, 1214 and 1218 have been adjusted to minimum gain level 1260.

As described above and shown in FIG. 12C, the adjusted gain is calculated at step 850 so that the mouth of the character is fully closed at each local minimum and fully open at each local maximum to give the character a more natural mouth motion. Otherwise, the lips of the character would appear to quiver mumble because there would not be a distinct opening and closing of the character's mouth. Users expect the mouth of a character to open fully and close fully within a set period of time. If the mouth does not open and close fully, then the character appears to quiver because the lips of the character never touch. If the mouth doesn't open far enough, the character appears to mumble. It should be understood that the local minima and local maxima for gain could be determined at intervals of less than or greater than 4 frames. However, it has been determined that having the mouth fully open and fully close within 60–80 milliseconds provides a smooth mouth motion for the animated or mechanical character.

Figure 12C:
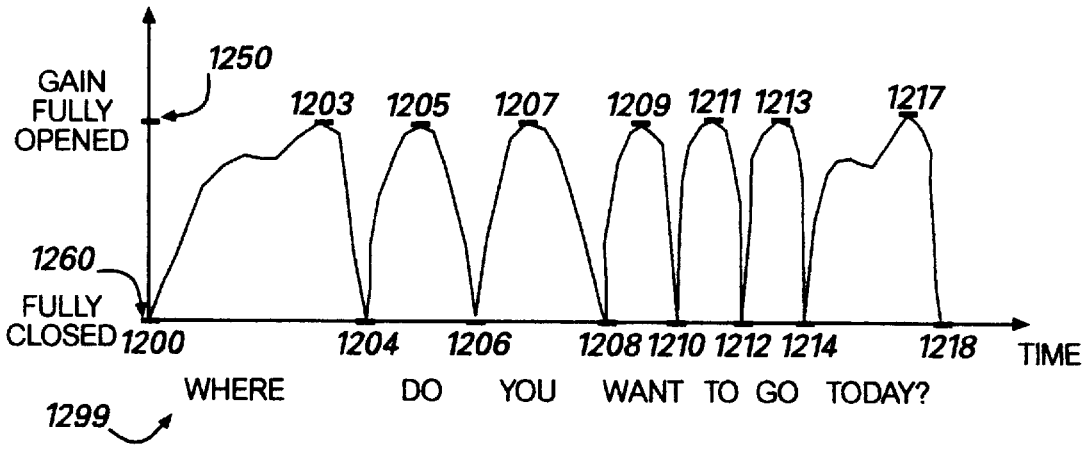
FIG. 12C is an illustration of the gain coefficient of an example phrase plotted over time in which the local minima and local maxima have been scaled.

Thus, for example, referring to FIGS. 12B and 12C, suppose frames 1200–1204 are local maxima and local minima for the first word. After finding the first local minimum 1200, the gain analysis looks for the next local maximum to set to the maximum opening of the mouth. Local maximum 1201 is discarded because it is too close to the last local minimum 1200. The gain analysis searches for the next local maximum 1203 and assigns it as the maximum opening of the mouth. The gain analysis continues this process of searching for local maxima and minima. In cases where the first local maximum is too close to the local minimum and the next local maximum is too far from the local minimum, as in 1205 and 1207, the gain analysis divides the distance, or time period, between the closing local minima, 1204 and 1208, by the number of local maxima, moves the local maximum to the middle of this divided distance, and moves the local minima to the ends of this divided distance. This also occurs for local minima and maxima 1208–1214. If the distance between local minima is too small to be a strong word and syllable break, as in 1214–1218, the gain analysis will choose the largest of the local maxima to be the maximum opening. The whole segment is then scaled between the range of fully closed and fully open.

Referring to FIG. 8, for each frame, the gain from step 830, or the gain from step 850 (if the frame includes a local maximum or minimum), and the vector quantization result from step 840 are applied to an empirically derived mapping function at step 855. As described above, the gain represents the amount of space between the lips of the character, i.e., how wide the mouth is open. The vector quantization result represents the position of the lips for the sound the character is making. In one embodiment, applying the gain and vector quantization result to the empirically derived mapping function results in the most similar mouth shape that can be presented by the servo motor 69 driving the mouth of the Realmation Performer 60.

Figure 11:
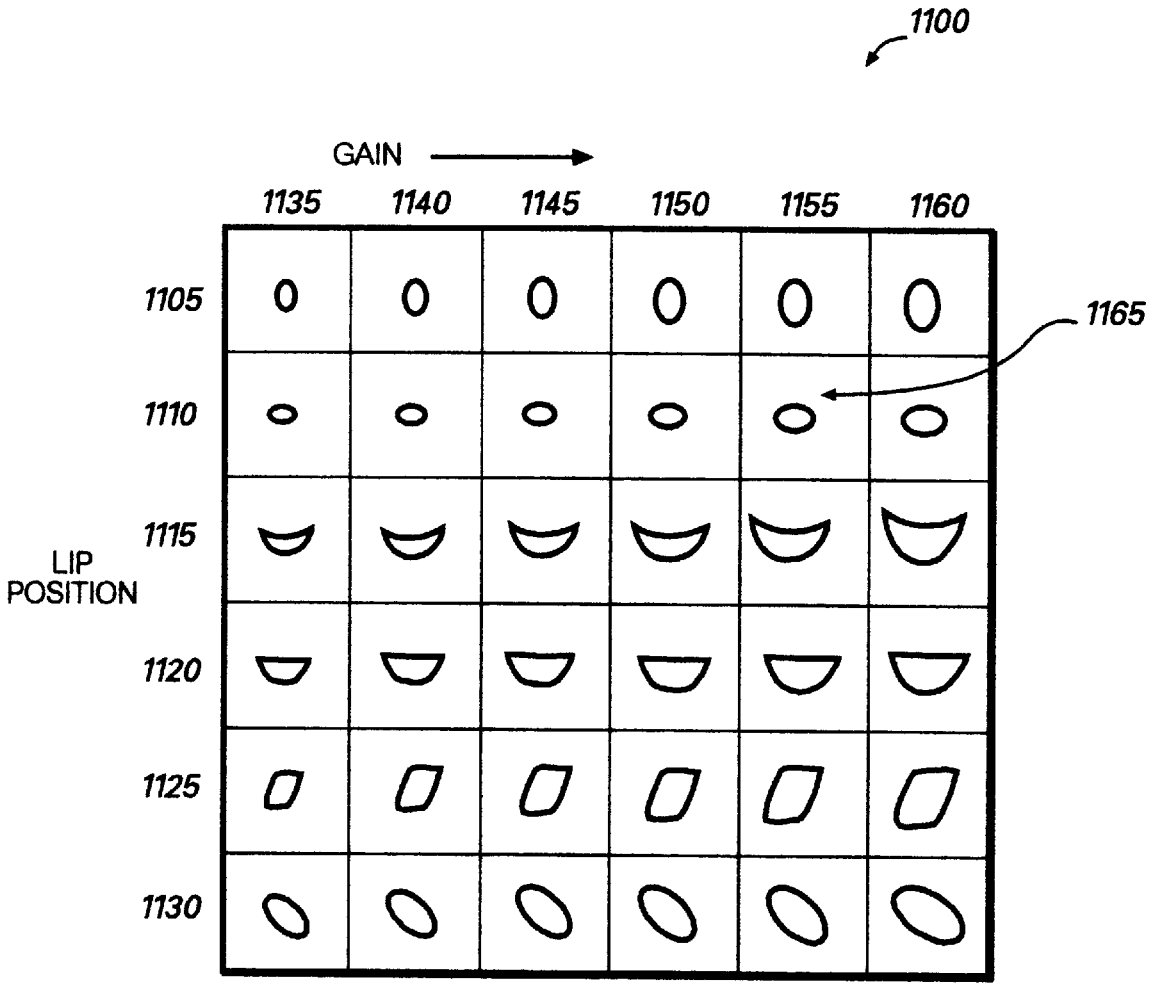
FIG. 11 is an illustration of a representative example of an empirically derived mapping function that may be used to determine the mouth features of an animated or mechanical character.

Referring now to FIG. 1, a representative example of the empirically derived mapping function 1100 that could be used at step 855 to determine the mouth shape is illustrated. As shown in FIG. 11, each row, 1105–1130, represents a different lip position and each column, 1135–1160, represents a different gain value. The gain value is lowest at column 1135 and highest at column 1160. To determine the mouth features for each frame, the lip position, or row, is combined with the mouth opening, or column, and the resulting mouth feature cell is determined. For example, suppose the lip position corresponds to row 1110 and the gain, or mouth opening, corresponds to column 1155. For this hypothetical, the resulting mouth feature is contained in cell 1165.

For a mechanical character, the empirically derived mapping function may be implemented as a lookup table that results in commands being sent to the mechanical character to drive the servo motors of the mouth into the proper mouth features. For example, in one embodiment, the lookup table may be stored in system memory 22 of computer 20 (FIG. 2). The mouth features that are determined from the lookup table may be sent by Realmation Link Master 80 as control data to the Realmation Performer 60 to set the servo motor 69*a* that controls the mouth features of the Realmation Performer. As another example, for an animated character, the empirically derived mapping function may result in a display of a mouth shape on a display device. The cell animator may then directly incorporate the displayed mouth shape into the animation cell or use the displayed mouth shape as a reference when drawing the mouth shape of the character.

After the gain and the vector quantization result are applied to an empirically derived mapping function at step 855, then the method ends at step 860.

From the foregoing description, it will be apparent to those skilled in the art that the present invention provides a quick, efficient and accurate method for determining lip position and mouth opening for both mechanical and animated characters. It will be further apparent that the present invention provides a method for determining lip position and mouth opening that has a fine granularity, i.e., provides an accurate representation of lip position and mouth opening. It will also be apparent that the present invention provides a method for determining lip position and mouth opening that is compatible with a digital environment.

Those skilled in the art will further appreciate that, in the embodiments including a Realmation Performer 60, the mouth feature data must be sent to the Realmation Performer before the voice signal that is to be spoken by the Realmation Performer. This is because the servos 69 that control the lip position and mouth opening of the Realmation Performer 60 require time to be set.

Although the present invention has been described above as implemented in the preferred realmation system, it will be understood that alternative embodiments will become apparent to those skilled in the art to which the present invention pertains without departing from its spirit and scope. Accordingly, the scope of the present invention is defined by the appended claims rather than the foregoing description.

What is claimed is:

1. A method for determining the mouth features for a speaking character, comprising the steps of:

sampling a time-domain audio signal;

separating the time-domain audio signal into a plurality of frames;

applying a window to each of the plurality of frames; and applying a linear predictive coding (LPC) technique to each of the plurality of frames to achieve a plurality of LPC coefficients and a gain for each of the plurality of frames, whereby the LPC coefficients and gain for each frame are used to determine the mouth features for the character on a frame-by-frame basis.

2. The method recited in claim 1, further comprising the step of:

transmitting the LPC coefficients and the gain for each of the frames to the character.

3. The method recited in claim 1, further comprising the steps of:

mapping the plurality of LPC coefficients to the Cepstral domain for each frame to obtain a plurality of Cepstral coefficients for each frame;

vector quantizing the Cepstral coefficients to obtain a vector quantization result corresponding to a lip position of the character; and applying the vector quantization result and the gain for each frame to a mapping function to obtain the mouth features of the character for each frame.

4. The method recited in claim 3 wherein the mapping function is defined by a lookup table.

5. The method recited in claim 3 further comprising the steps of:

before applying the vector quantization result and the gain for each frame to the mapping function, determining a plurality of local maxima for gain and a plurality of local minima for gain within a predetermined number of frames;

discarding local maxima which occur too close to the last local minimum;

discarding local minima which occur too close to the last local maximum;

adjusting the gain for a frame containing one of the local minima to equal a minimum gain level;

adjusting the gain for a frame containing one of the local maxima to equal a maximum gain level;

averaging the distance between the local minima and local maxima; and scaling the gain of all of the frames between the range of minimum gain level to maximum gain level.

6. The method recited in claim 5 wherein the minimum gain level corresponds to a minimum mouth opening for the character and the maximum gain level corresponds to a maximum mouth opening for the character.

7. The method recited in claim 5 further comprising the step of determining a minimum distance between local minima.

8. The method recited in claim 5 further comprising the step of causing the distance between local maxima to be averaged between the closing local minima.

9. The method recited in claim 5 further comprising the step of scaling the gain between the range of fully closed to fully open.

10. A computer-readable medium having computer-readable instructions for performing the steps recited in claim 5.

11. A computer-implemented method for generating mouth features of a character, comprising the steps of:

sampling a time-domain voice signal;

separating the time-domain voice signal into a plurality of frames;

applying a windowing technique to each frame;

applying a linear predictive coding (LPC) technique to each of the plurality of frames to generate a plurality of LPC coefficients and a gain for each frame;

mapping the plurality of LPC coefficients to the Cepstral domain to obtain a plurality of Cepstral coefficients for each frame;

vector quantizing the Cepstral coefficients to obtain a lip position for each frame;

determining a local maximum of the gain and a local minimum of the gain within a predetermined number of frames;

adjusting the gain for the frame containing the local minimum to equal a minimum gain level;

adjusting the gain for the frame containing the local maximum to equal a maximum gain level; and applying the lip position and the gain for each frame to an empirically derived mapping function to obtain the mouth features of the character for each frame.

12. The computer-implemented method recited in claim 11 wherein the step of sampling the time-domain voice signal comprises digitally sampling the time-domain voice signal.

13. The computer-implemented method recited in claim 11 wherein the step of applying a windowing technique to each of the plurality of frames comprises the step of applying a Hamming window to each frame.

14. The computer-implemented method recited in claim 11 wherein the character is a computer-animated character, further comprising the steps of:

reproducing the time-domain voice signal through a speaker; and displaying on a display device the mouth features of the computer-animated character in unison with reproduction of the time-domain voice signal via the speaker.

15. The computer-implemented method recited in claim 11 wherein the character is a mechanical character having a speaker, a pair of lips, and at least one motor for controlling the position of the lips, further comprising the steps of:

audibly broadcasting the time-domain voice signal through the speaker; and activating each motor to move the pair of lips in unison with the time-domain voice signal such that, for each frame of the time-domain voice signal, the pair of lips corresponds to the mouth features obtained through the empirically derived mapping function for the frame of the timedomain voice signal that is being audibly broadcast.

16. A computer system for synchronizing the mouth features of a speaking performer to a voice signal transmitted by the performer, comprising:

a processor; and a memory storage device for storing a program module;

the processor, responsive to instructions from the program module, being operative to:

sample the voice signal;

break the voice signal into a number of frames;

apply a windowing technique to each of the frames;

apply a linear predictive coding technique to each frame to obtain a number of reflection coefficients and a gain coefficient for each frame;

transform the reflection coefficients into Cepstral coefficients;

determine a lip position for each frame that corresponds to the Cepstral coefficients for each frame;

adjust the gain of certain frames of the voice signal so that a mouth of the performer fully opens and fully closes within a predetermined number of frames; and determine the mouth features corresponding to each frame using the gain and lip position for each frame.

17. The computer system of claim 16 wherein the windowing technique applies a window to each frame to avoid discontinuities of each frame.

18. The computer system of claim 16 wherein the processor is further operative to adjust the gain of certain frames by:

determining a local maximum for gain and a local minimum for gain for a predetermined number of frames of the voice signal;

adjusting the gain for the frames containing a local minimum for gain to equal a minimum gain; and adjusting the gain for the frames containing a local maximum for gain to equal a maximum gain.

19. The computer system of claim 18 wherein the minimum gain corresponds to the mouth of the character being fully open and the maximum gain corresponds to the mouth of the character being fully closed.

20. The computer system of claim 16 wherein the processor is further operative to determine the mouth features corresponding to each frame by:

applying the gain and lip position for each frame to a mapping function to obtain data commands corresponding to the mouth features of the performer for each frame;

receiving data commands based upon the mapping function; and transmitting the data commands to the performer.

* * * * *